US005104290A

United States Patent [19]

Catlow

[11] Patent Number: 5,104,290

[45] Date of Patent: Apr. 14, 1992

[54] BLADED ROTOR WITH AXIALLY EXTENDING RADIALLY RE-ENTRANT FEATURES

[75] Inventor: Ronald Catlow, Spondon, England

[73] Assignee: Rolls-Royce plc, London, England

[21] Appl. No.: 591,211

[22] Filed: Oct. 1, 1990

[30] Foreign Application Priority Data

Nov. 9, 1989 [GB] United Kingdom ..... 8925313

[51] Int. Cl.[5] ..... B63H 1/14

[52] U.S. Cl. ..... 416/96 R; 416/217; 416/219 R; 415/115

[58] Field of Search ..... 415/115, 114, 116; 416/96 R, 97 R, 204 A, 217, 219 R, 220 R, 95

[56] References Cited

U.S. PATENT DOCUMENTS

| | | | |
|---|---|---|---|
| 2,859,935 | 11/1958 | Roesch | 415/115 |
| 3,297,301 | 1/1967 | Petrie et al. | 416/220 R |
| 3,519,368 | 7/1970 | Howald . | |
| 3,700,348 | 10/1972 | Corsmeier et al. | 416/95 |
| 3,719,431 | 3/1973 | Steele et al. | 416/220 R |
| 3,749,514 | 7/1973 | Kelch et al. | 416/95 |
| 3,832,090 | 8/1974 | Matto | 416/95 |
| 4,260,331 | 4/1981 | Goodwin | 416/219 R |
| 4,344,738 | 8/1982 | Kelly et al. | 416/95 |
| 4,759,688 | 7/1988 | Wright et al. | 416/96 R |

FOREIGN PATENT DOCUMENTS

| | | | |
|---|---|---|---|
| 0274978 | 7/1988 | European Pat. Off. . | |
| 0275726 | 7/1988 | European Pat. Off. . | |
| 555135 | 8/1943 | United Kingdom . | |
| 609446 | 9/1948 | United Kingdom . | |
| 618037 | 2/1949 | United Kingdom . | |
| 0872705 | 7/1961 | United Kingdom | 416/97 R |
| 0895077 | 5/1962 | United Kingdom | 416/96 R |
| 1408492 | 10/1975 | United Kingdom . | |

*Primary Examiner*—Edward K. Look
*Assistant Examiner*—Christopher M. Verdier
*Attorney, Agent, or Firm*—Oliff & Berridge

[57] ABSTRACT

A bladed rotor (19) suitable for a gas turbine engine (10) comprises a plurality of aerofoil blades (21) mounted on the periphery of a disc (20). Each of the aerofoil blades (21) has a root part (25) which locates in the disc (20) and is constituted by two radially extending circumferentially spaced apart root portions (26,27). The circumferentially outward flanks of the root portions (26,27) are configured to define a fir-tree type blade fixing which locates in a correspondingly shaped recess (34) in the disc (20). The root part (25) configuration provides weight reduction in the rim region of the disc (20), thereby reducing stresses within the disc (20).

7 Claims, 2 Drawing Sheets

BLADED ROTOR WITH AXIALLY EXTENDING RADIALLY RE-ENTRANT FEATURES

This invention relates to a bladed rotor and in particular to a bladed rotor suitable for a gas turbine engine.

A gas turbine engine bladed rotor typically comprises a disc on the periphery of which are mounted radially extending aerofoil blades. Such bladed rotors are usually called upon to operate at very high rotational speeds and this can present problems associated with the mass of the rotor, particularly in the region of the disc rim. The disc rim region can, by virtue of its mass, create high centrifugal loadings and this has a limiting effect upon the maximum rotational speed of the disc as well as its life expectancy and safety reserves. Moreover as disc rotational speeds increase, so does the centrifugal loading from the aerofoil blades and so increased rim mass is required to carry that increased loading. It will be understood therefore that the mass of the disc rim has a critical effect upon the maximum speed at which the bladed rotor can safely operate.

It is an object of the present invention to provide a bladed rotor having a rim of reduced mass.

According to the present invention, a bladed rotor suitable for a gas turbine engine comprises a disc, on the periphery of which are mounted a plurality of radially extending aerofoil blades, each of said blades having a root part which locates and is retained within a corresponding recess in the rim of said disc, each of said root parts comprising two generally radially extending circumferentially spaced apart root portions, each of said root portions having circumferentially outward flanks provided with axially extending, radially re-entrant features which locate in corresponding features provided in each of said recess to facilitate said blade root retention, spacer means being provided to maintain said generally radially extending root parts in fixed circumferentially spaced apart relationship.

The invention will now be described, by way of example, with reference to the accompanying drawings in which FIG. 1 is a sectioned side view of the upper half of a ducted fan gas turbine engine incorporating a bladed rotor in accordance with the present invention.

Figure 1:
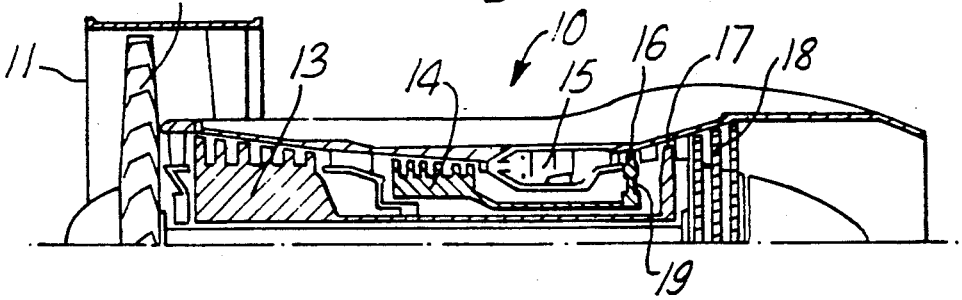

With reference to FIG. 1, a ducted fan gas turbine engine generally indicated at 10 comprises an air intake 11 in which is located a propulsive fan 12. Downstream of the fan 12 there are provided intermediate and high pressure compressors 13 and 14 respectively and combustion equipment 15. A high pressure turbine 16 is located downstream of the combustion equipment 15 and is drivingly connected to the high pressure compressor 14. Similarly intermediate and low pressure turbines 17 and 18 located downstream of the high pressure turbine 16 are drivingly connected to the intermediate pressure compressor 13 and fan 12 respectively.

The ducted fan gas turbine engine 10 functions in the conventional manner whereby air drawn in through the intake 11 passes through the fan 12 and is divided in two flows. The first flow provides propulsive thrust while the second flow is directed into the intermediate pressure compressor 13 and subsequently into the high pressure compressor 14. The air, having been compressed by the compressors 13 and 14, is then directed into the combustion equipment 15 where it is mixed with fuel and the mixture is combusted. The resultant combustion products then expand through, and thereby drive, the high, intermediate and low pressure turbines 16,17 and 18 before being exhausted from the engine 10 to provide further propulsive thrust.

Figure 2:
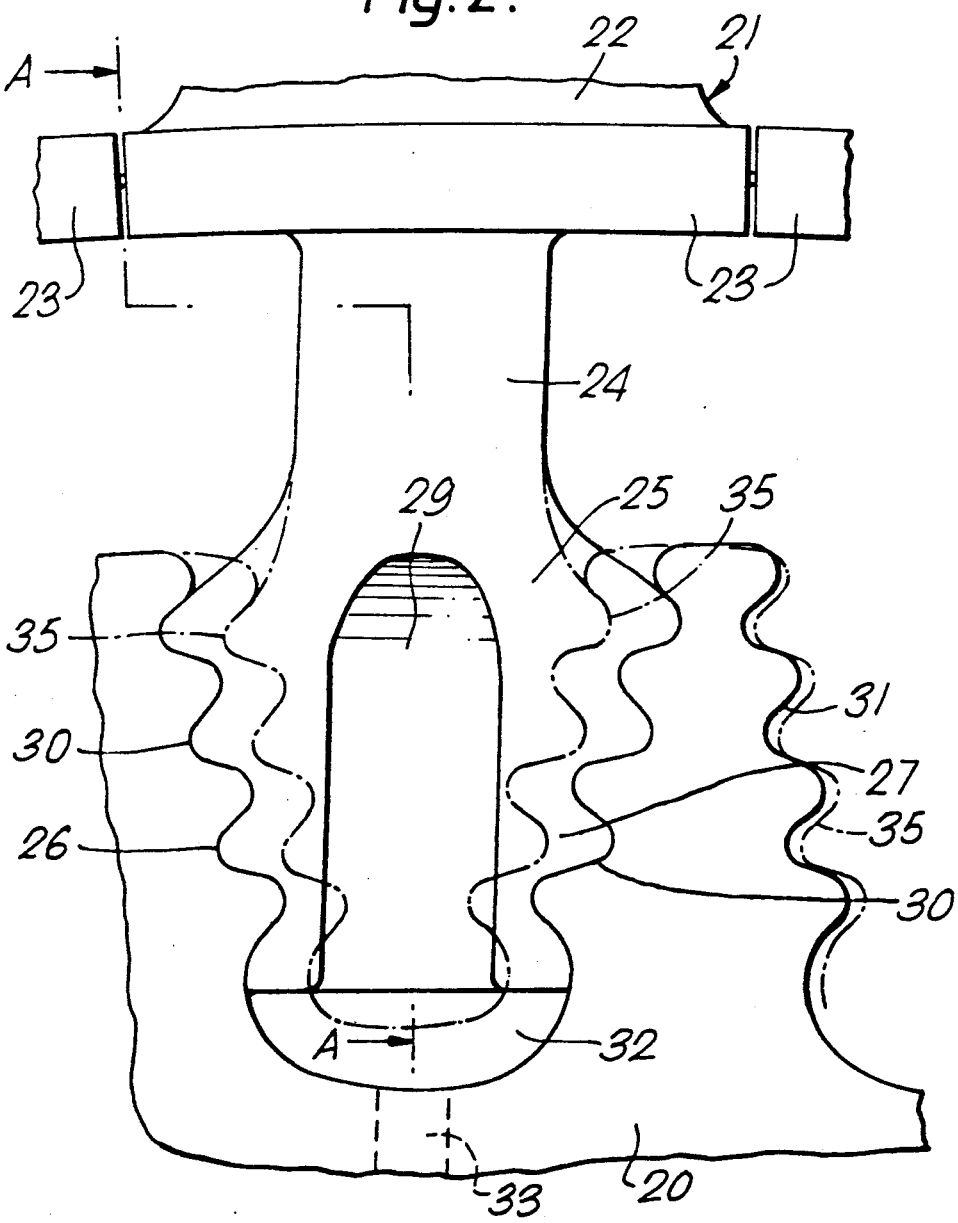
FIG. 2 is a view of a part of a bladed rotor of the ducted fan gas turbine engine shown in FIG. 1 viewed in an axial direction.

The high pressure turbine 16 includes a bladed rotor 19, a portion of which can be seen more clearly if reference is now made to FIG. 2.

Figure 3:
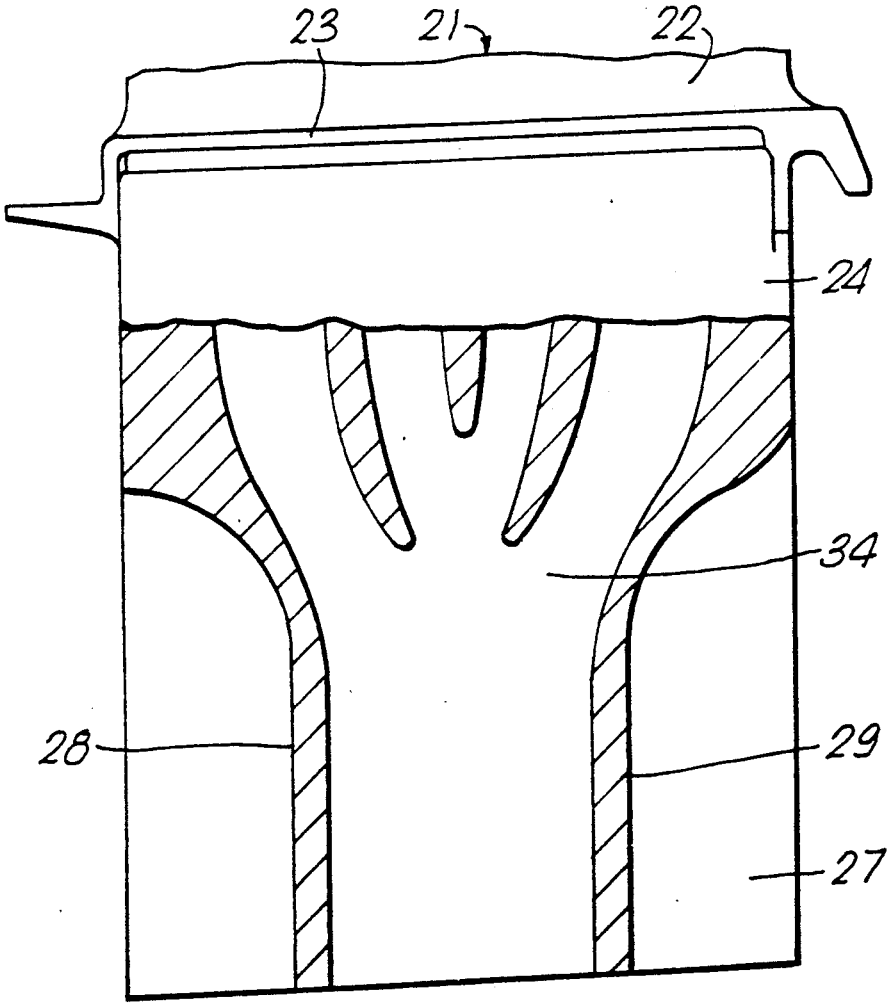
FIG. 3 is a view on section line A—A of FIG. 2.

The bladed rotor 19 comprises a disc 20 around the periphery of which are mounted a plurality of equally spaced apart, radially extending aerofoil blades 21. Each aerofoil blade comprises an aerofoil portion 22, only a portion of which is visible in FIGS. 2 and 3, a platform 23, a shank 24 and a root part 25. The root part 25 is constituted by two generally radially extending, circumferentially spaced apart root portions 26 and 27. Walls 28 and 29, which can be seen more clearly in FIG. 3 are inwardly spaced from the axial extents of the root part 25 and maintain the root portions 26 and 27 in fixed circumferentially spaced apart relationship.

Each of the root portions 26 and 27 is provided on its circumferentially outward flanks with axially extending radially re-entrant features 30 so that the root portions 26 and 27 together define the well known fir-tree root type blade fixing.

The rim of the disc 20 is provided with recesses 32 having correspondingly shaped re-entrant features 31 on their circumferential flanks which cooperate with the features 30 on the blade root portions 26 and 27 in order to facilitate radial retention of the aerofoil blades 21. It will be appreciated however that easy removal of the aerofoil blades 21 from the disc 20 is achieved by sliding each blade 21 in an axial direction until it is free of the disc 20. Removable plates (not shown) are located around the disc 20 rim in accordance with established practice to ensure that such axial sliding is prevented during normal operation of the gas turbine engine 10.

Each of the recesses 32 is provided with a flow of cooling air via a corresponding duct 33 provided within the disc 20. The cooling air flows between the walls 28 and 29 of each blades 21 to enter the blade interior 34. Thus cooling of each aerofoil blade 21 is achieved in the conventional manner.

In a conventional bladed rotor having a fir-tree type of blade root fixing, the blade roots (and the disc recesses in which they locate) would normally have a profile as indicated by the interrupted lines 35. Such a profile 35 is consistent with each aerofoil blade 21 being provided with adequate radial support by the disc 20. However in the case of the present invention, the circumferential extent of each blade root part 25 is increased so that the circumferential distance between adjacent disc recesses 32 is correspondingly decreased. In fact the distance between adjacent recesses is the minimum which is consistent with the strength characteristics of the disc 20 and the operational centrifugal loading imposed by each of the aerofoil blades 21.

It will be seen therefore that the present invention provides a reduction in overall weight of the disc 20 rim as a result of the blade root part 25 being constituted by two portions 26 and 27 which are in spaced apart relationship. Such a reduction in weight brings about advantages arising from the corresponding reduction in centrifugal loading which is imposed by the disc 20. Thus for a given operational rotational speed of the bladed rotor 19, the reduction in mass of the disc 20 rim as compared with that of a conventional bladed rotor ensures that stressing of the disc 20 is reduced, thereby resulting in larger rotor life. Alternatively if the stressing of the disc 20 is maintained at the same levels as those of conventional bladed rotors, the rotational speed of the bladed rotor 19 may be increased, thereby bringing about improvements in rotor efficiency.

A further advantage of bladed rotors 19 in accordance with the present invention is that the centre of gravity of each aerofoil blade 21 is radially further outward than that of conventional aerofoil blades. This ensures that during operation of the bladed rotor 19 each of the aerofoil blades is stiffer than conventional aerofoil blades and therefore less prone to problems associated with vibration.

I claim:

1. A bladed rotor suitable for a gas turbine engine comprising a disc having a rim on its periphery, and a plurality of aerofoil blades mounted on said rim so that each of said aerofoil blades is generally radially extending, each of said blades having a root part which locates and is retained within a corresponding recess in said rim of said disc, each of said root parts comprising two generally radially extending circumferentially spaced apart root portions, each of said root portions having circumferentially outward flanks provided with axially extending, radially re-entrant features which locate in corresponding features provided in each of said recesses to facilitate said blade root retention, and wall means for spacing said generally radially extending root parts in a fixed, circumferentially spaced apart relationship, said wall means extending between said two generally radially extending root parts and defining a space therebetween.

2. A bladed rotor as claimed in claim 1 wherein each of said recesses in said disc rim is circumferentially spaced apart from adjacent recesses by a minimum distance consistent with strength characteristics of said disc and operational centrifugal loading imposed by each of said blades on said disc.

3. A bladed rotor as claimed in claim 1 wherein said axially extending radially re-entrant features on said each of said root parts define a fir-tree type blade root configuration.

4. A bladed root as claimed in claim 1 wherein said wall means are inwardly spaced from the axial extents of the root part with which they are associated.

5. A bladed rotor as claimed in claim 4 wherein each of said blades has an interior and said wall means define at least one cooling air entry passage into said interior of the blade with which they are associated.

6. A bladed rotor as claimed in claim 4 wherein said wall means on each of said root portions comprises two spaced circumferentially extending walls.

7. A bladed rotor as claimed in claim 1, wherein each of said root parts is substantially entirely divided into said two generally radially extending circumferentially spaced apart root portions.

* * * * *